US006089432A

United States Patent [19]

Gage et al.

[11] Patent Number: 6,089,432

[45] Date of Patent: Jul. 18, 2000

[54] CONCEALMENT HOLSTER FOR HANDGUNS

[76] Inventors: David Austin Gage, 61 Lafeatte; Charles Franklin Gage, 110 Colbath, both of Las Vegas, Nev. 89110

[21] Appl. No.: 09/205,141

[22] Filed: Dec. 3, 1998

[51] Int. Cl.[7] ..... F41C 33/02

[52] U.S. Cl. ..... 224/587; 224/191; 224/911; 224/912

[58] Field of Search ..... 224/911, 912, 224/191, 587

[56] References Cited

U.S. PATENT DOCUMENTS

| | | | |
|---|---|---|---|
| 317,128 | 5/1885 | Hanscom . | |
| 881,044 | 3/1908 | Audley . | |
| 1,173,376 | 2/1916 | Noye . | |
| 1,295,831 | 3/1919 | Alderson . | |
| 2,951,622 | 9/1960 | Heim et al. . | |
| 3,227,336 | 1/1966 | Dickey . | |
| 3,583,612 | 6/1971 | Theodore . | |
| 3,707,250 | 12/1972 | Esposito . | |
| 3,749,293 | 7/1973 | Bianchi . | |
| 3,915,361 | 10/1975 | Perkins | 224/911 |
| 4,235,356 | 11/1980 | Atchinson | 224/192 |
| 4,270,680 | 6/1981 | Bianchi | 224/193 |
| 5,265,781 | 11/1993 | Nichols | 224/911 |
| 5,441,187 | 8/1995 | Mixson | 224/243 |

OTHER PUBLICATIONS

Leatherwood Holsters Catalog, "Specializing in Cocealed Carry", Summer 1992, pp. 1–3, 6–9, 14–17.

*Primary Examiner*—Linda J. Sholl
*Attorney, Agent, or Firm*—Fulbright & Jaworski L.L.P.

[57] ABSTRACT

A concealment holster constructed from a support member sandwiched between a glove and thumb break member and a paddle member having outwardly extending wings. The lower portion of the glove and thumb break and the wings are worn beneath the trousers of the wearer below the waist with the handgun enclosure extending above the waist of the trousers in such a manner as to be easily concealed by a coat, sweater, windbreaker, or the like.

9 Claims, 3 Drawing Sheets

CONCEALMENT HOLSTER FOR HANDGUNS

BACKGROUND OF THE INVENTION

1. Field of the Invention

The present invention relates generally to holsters for handguns and more specifically to a holster which is adapted for wearing with the lower portion thereof inside and below the waist of the trousers of the wearer.

2. Description of the Related Art

Holsters which are carried on a wearer's belt are very well known in the art. Often a holster includes a belt loop or an inner surface which is placed against a wearer's body. A belt is inserted in the loop to secure the holster to the wearer. One problem with holsters of this type is their tendency to slip or slide with respect to the belt. Such sliding can occur when a wearer is walking or running. This problem is heightened when a handgun is being withdrawn from the holster. The holster slides forward or aft on the belt as the gun is withdrawn depending on the motion of draw. In crucial situations, such as a draw by a law enforcement officer, a sliding holster can result in a slow and ineffective draw.

Another problem with such holsters is that they tend to sag and droop away from the wearer's body. Once a handgun is inserted into a holster, the weight of the gun pulls the holster away from the body. Such a holster is not snug or stable against a wearer's body particularly when walking or running. Furthermore, comfort and concealment of a handgun in such a holster is not satisfactory.

In addition to the foregoing, the security of handguns contained in such holsters has been a problem. As a result there has been developed in the prior art the utilization of a thumb break security strap which is included as a part of the holster and it extends upwardly therefrom and over the handgun at approximately the hammer location thereof to retain the handgun in place but at the same time allows the user the ability to release the thumb break with a relatively rapid and simple movement of the thumb. In prior art holsters, this movement has been toward the body of the user.

The devices of the prior art although working well under most circumstances generate problems as above referred to and attempts have been made to correct some of the problems. Holsters, particularly concealment holsters, which are worn inside the trousers of the user have also been used in the prior art and such holsters have also been utilized including thumb breaks as a part thereof. However, such concealment holsters have also utilized belt loops or other complicated structures thereon to assist in retaining the holster on the person of the wearer. Such holsters still include some of the same disadvantages and problems recognized in the prior art and many such holsters employ complex structures devices and construction techniques adding to the overall complexity, difficulty of manufacturing and increased costs.

Typical of such prior art holsters utilizing improved thumb break security straps are those shown in U.S. Pat. Nos. 4,270,680, 5,199,620 and 5,441,187. Typical of holsters which are designed for concealment and which utilize structures adapted for wearing inside the trousers of the user are those illustrated in U.S. Pat. Nos. 3,583,612, 4,235,356, 4,759,482 and 5,054,670. A holster designed to control the slippage on a belt loop is disclosed in U.S. Pat. No. 4,718,585.

SUMMARY OF THE INVENTION

The present invention provides a concealment holster for holding a handgun in such a manner as to permit its withdrawal by a generally vertically upward movement and adapted in such a manner as to be retained upon the person of the user without the necessity of a belt loop. The concealment holster of the present invention is designed for wearing inside the trousers of the user and includes a paddle member having a pair of wings extending outwardly from a lower portion thereof. A portion of the paddle member and the wings extend below the waist of the trousers. A glove member is affixed to the paddle member and includes a portion for receiving a handgun as a well as a lower extension which is substantially co-extensive with that portion of the paddle member which contains the outwardly extending wings. A support member is sandwiched between the paddle member and the glove member and the paddle member and glove member are permanently secured together to retain the support member therebetween.

In accordance with a more specific aspect of the present invention, the paddle member and glove member are cut from individual unitary leather pieces with the glove member including a thumb break. The support member is constructed from a metallic member such as aluminum. The aluminum support member is adhesively secured between the glove member and the paddle member and then the paddle and glove members are stitched together thus, permanently securing the paddle member, glove member and support member together. The simple three-piece concealment holster is designed and adapted such that the paddle member with the wings is inserted beneath the trousers waist of the wearer with rough leather outer surfaces engaging the wearer's clothing to more securely hold the holster in position. The enclosure for receiving the barrel and trigger guard of the handgun extend above the belt line of the trousers of the wearer in such a manner that it may be easily concealed by a coat, jacket, sweater, windbreaker or the like worn by the user, while yet providing immediate and easy access to the handgun. The thumb break is structured to release in a direction away from the user's body. Thus, it is seen that the concealment holster of the present invention is simple and easily manufactured by cutting the glove and thumb break member and the paddle with wings member from leather blanks, partially assembling the same, adhesively securing the support member therebetween, forming the barrel and trigger guard enclosure and stitching the combination together to permanently secure the parts into the desired concealment holster.

DETAILED DESCRIPTION OF THE PREFERRED EMBODIMENT

Figure 1:
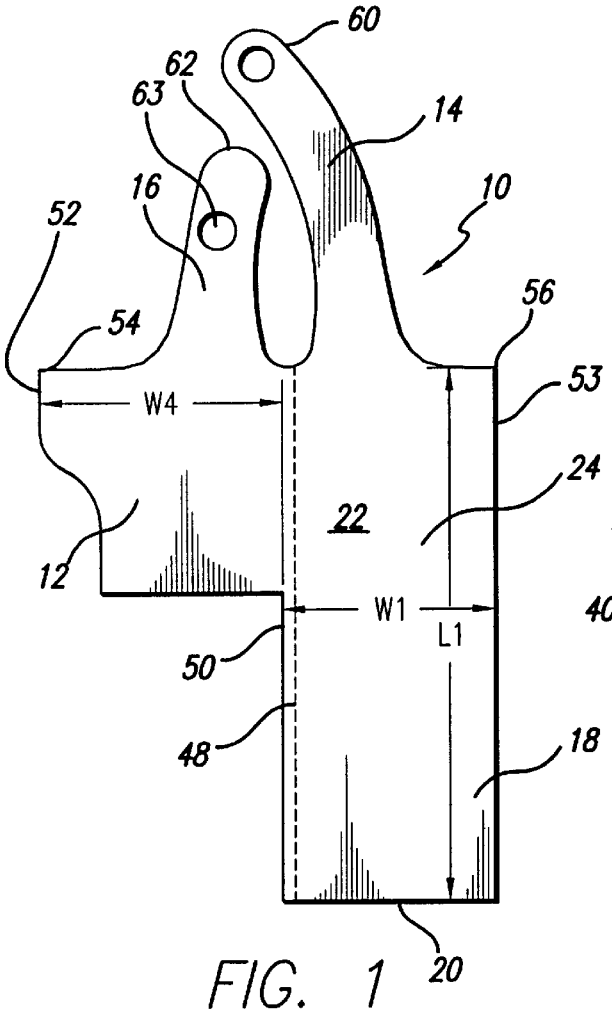
FIG. 1 is a plan view of the glove and thumb break member of the concealment holster of the present invention.

Referring now more particularly to FIG. 1, there is illustrated in plan view the glove and thumb break member of the concealment holster of the present invention. The member as illustrated in FIG. 1 is stamped from a leather blank into the shape as illustrated. As is illustrated in FIG. 1, the glove and thumb break member 10 includes a glove section 12 with a long thumb break 14 and a short thumb break 16, extending upwardly therefrom. A planar element 18 extends downwardly from the glove section 12 to the bottom 20 of the holster. As will become clearer from the description herein below the glove member is folded over the upper portion 24 of the planar member 18 and is stitched in position to provide the barrel and trigger guard enclosure for a handgun. It is important to note the simplicity of construction of the holster of the present invention. As can be seen from a consideration of FIG. 1, there is provided the handgun enclosure, the thumb break and a portion for retaining the holster in position on the body of the wearer all from one unitary stamped member. Preferably the glove and thumb break member 10 is stamped from a single unitary blank of leather. Although the thickness of the leather blank may be any thickness desired for the particular handgun under consideration, preferably the leather blank is on the order of one-eighth (⅛) inch in thickness and includes a finished side and a rough side. Preferably the rough side is the side 22 as shown in FIG. 1 with the finished side being on the reverse side thereof. The importance of the rough side will become apparent from the description contained herein below. It should also be noted that the planar element 18 of the glove member 10 has a first length L1.

Figure 2:
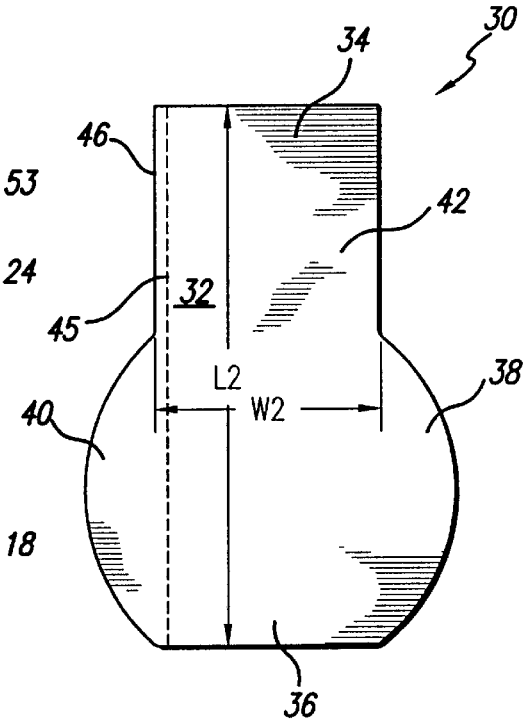
FIG. 2 is a plan view of the paddle with wings portion thereof.

Referring now more particularly to FIG. 2, there is illustrated in plan view, the paddle member 30 which includes a body portion 32 having a second length L2. Length L1 is substantially the same as length L2 but in the preferred embodiment of the present invention L2 is slightly larger than L1. It should also be noted that the width W1 of the planar element 18 of the glove and thumb break member 10 is substantially identical to the width W2 of the upper portion 34 of the body 32 of the paddle 30. Extending outwardly from the lower portion 36 of the body 32 are a pair of wings 38 and 40. The paddle 30 includes a finished surface which is the surface 42 of the body 32 as shown in FIG. 2. The opposite surface (not shown) is the rough surface of the paddle 30. Again, the importance of the rough and finished surfaces will become apparent from the description set forth below. The paddle and wings as illustrated in FIG. 2 are also stamped from a unitary separate piece of leather which may be any thickness desired. However, in accordance with the preferred embodiment of the present invention, the thickness of the leather blank from which the paddle 30 is cut is approximately one-quarter (¼) inch in thickness.

Figure 3:
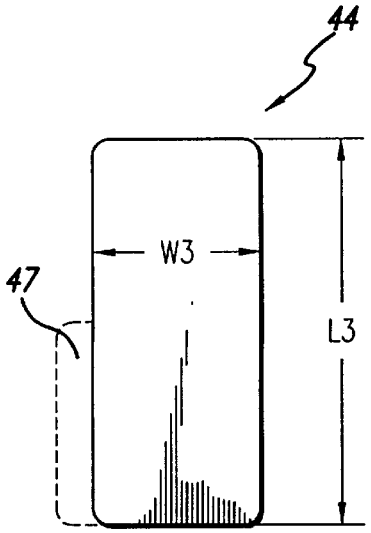
FIG. 3 is a plan view of the support member thereof.

Referring now more particularly to FIG. 3, a support member constructed in accordance with the principles of the present invention is illustrated in plan view. The support member 44 is preferably constructed from metal and more specifically the desired metal is an aluminum plate having a thickness of approximately one-sixteenth (1/16) inch, although any thickness desired may be utilized. The support member 44 has a length L3 which is somewhat less than L2 and a width W3 which is somewhat less than W1 and W2. Although the support member 44 is preferably constructed from an aluminum plate which has been die cut to the dimensions above set forth, it should also be understood that the support member may be constructed from other materials which provide the appropriate support and flexibility needed for a concealment holster constructed in accordance with the principles of the present invention. For example, the support member may be constructed from plastic materials such as polyvinylchloride or the like.

In construction of the concealment holster of the present invention, a glue or adhesive bead 45 is placed along the top or finished surface 42 and along the edge 46 thereof of the paddle 30. An additional glue or adhesive bead is placed on the finished side which is away from the side 22 of the glove and thumb break member 10 as is illustrated by the dashed line 48 of FIG. 1. The glove and thumb break member 10 is then positioned on top of the paddle member 30 with the adhesive beads 48 and 45 in contact and the combination is allowed to set until the adhesive has dried, thereby securing the glove member 10 on top of the paddle 30 with only the edges 46 of the paddle member 30 and 50 of the glove and thumb break member 10 and the upper portion 24 along the glue head 48 are adhesively secured together. After the adhesive has dried, the edges 46 and 50 are permanently secured together by stitching along the same lines as the adhesive beads 45 and 48 as illustrated in FIGS. 1 and 2. As a result, the glove member 10 is now permanently affixed by the stitching to the paddle 30 with the rough sides of both the paddle and the glove facing outwardly.

In the next step of the assembly of the concealment holster of the present invention the barrel and trigger guard enclosure portion of the holster is formed. This is accomplished by folding the glove section 12 as seen in FIG. 1 such that the edge 52 thereof mates with the edge 53 of the glove member 10. One will recognize that the width as shown at W4 of the glove section 12 is substantially identical to the width W1 of the planar member 18. Such would cause the corners 54 and 56 to effectively be brought together. Typically glue is applied on the surface 22 along the edge 52 to assist in retaining the glove 12 in position. After being so positioned the glove is stitched adjacent the edge 52 to the upper portion 24 of the planar section 18 of the glove member 10. When such is done it will be recognized that the short thumb break 16 will overlie the long thumb break 14, thus, placing the thumb break in position for further assembly as will be described below.

Subsequent to the glove section 12 being stitched in position, the support member 44 is inserted into the space between the planar member 18 of the glove member 10 and the body section 42 of the paddle 30. The width W3 of the support member 44 is less than the width W1 of the planar member 18 by an amount sufficient for the support member to be inserted between the glove member 10 and paddle member 30 in the space left after the barrel and trigger guard enclosure portion is formed and with sufficient room to permit stitching along the remaining sides and bottom. Prior to insertion of the support member 44 between the glove and paddle members in the space provided, it is coated with adhesive to assist in holding it in position while the stitching is being accomplished. If additional support is desired in the lower portion 18 of the glove below the enclosure portion, the support member may be formed as illustrated by the dashed line in FIG. 3. That is, an extension 47 may be provided which will fit below the bottom of the barrel and trigger guard enclosure and extend substantially across the width of the lower portion of the planar member 18.

Subsequent to the stitching to secure the support member 44 in place, appropriate holes are punched in the upper ends 60 and 62 of the thumb breaks 14 and 60 respectively to provide openings to attach an appropriate stud and eyelet and a washer, socket and felt pad. A stud with the eyelet is attached on the long thumb break 14 while the metal washer and socket is attached on the short thumb break 16. The felt pad 63 is attached to the back of the eyelet to preclude the eyelet scratching or abroding or otherwise damaging the handgun when inserted into the glove section 12. The glove section 12 is wet and a proper handgun form is inserted into it and it is allowed to dry and shrink to the desired conformation for receiving the barrel and trigger guard of the desired handgun.

Figure 4:
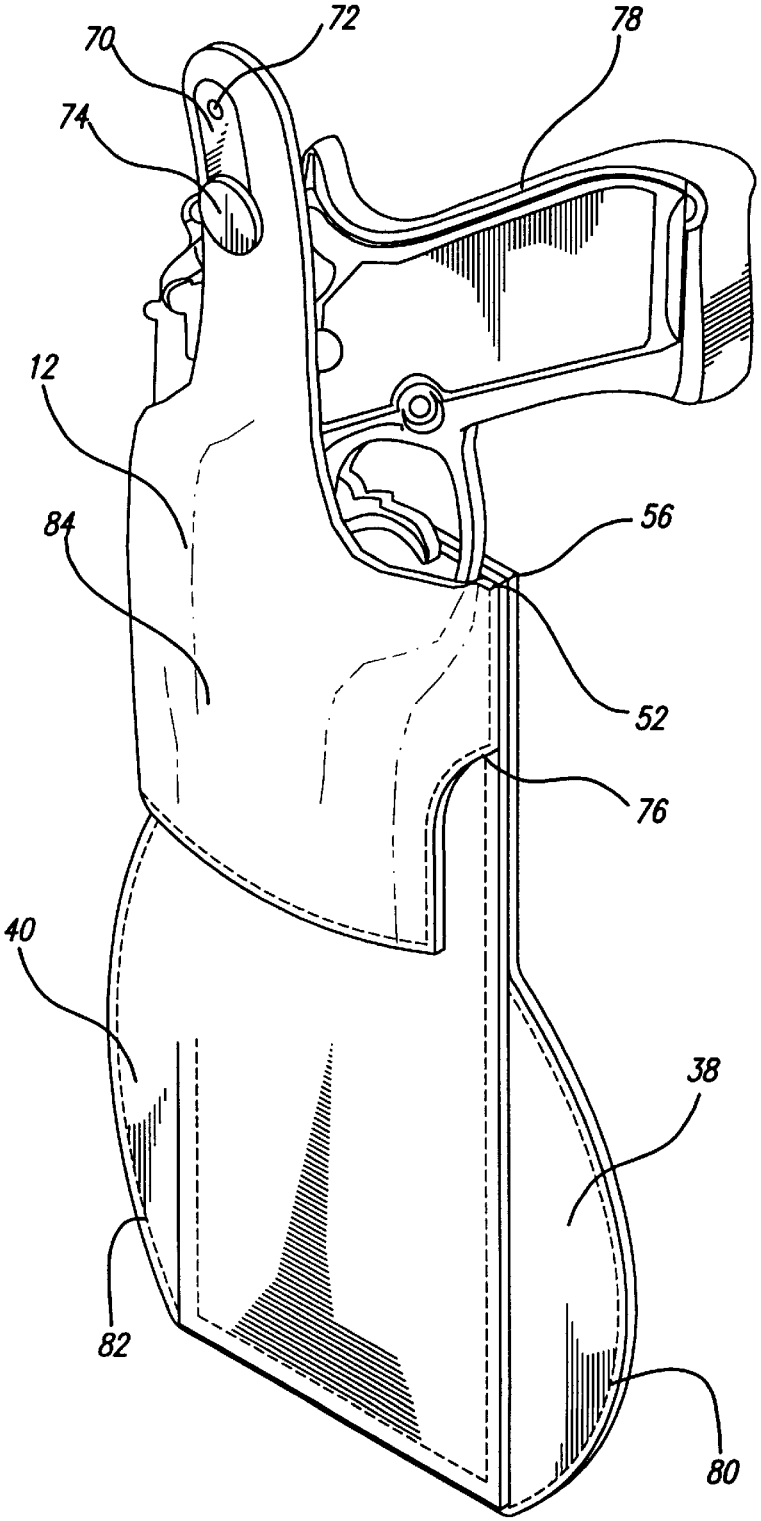
FIG. 4 is a perspective view of the completed concealment holster constructed in accordance with the principles of the present invention.

By reference now to FIG. 4, there is illustrated the completed concealment holster with a handgun in place and the thumb break secured thereover. As is illustrated, a metal washer 70 is riveted in place with the rivet 72 and the cap 74 which covers the socket appearing on the opposite side. The socket mates with the stud which is affixed to the long thumb break 14. As is clearly shown, the glove section 12 has been folded over so that the corners 52 and 56 are adjacent to each other and appropriate stitching 76 has been applied to secure the same in place. As is shown a handgun 78 is inserted in place with the barrel and trigger guard appropriately received in the enclosure therefor formed by the glove section 12. Decorative stitching such as shown at 80 and 82 is applied to the periphery of the outwardly extending wings 40 and 38. Decorative stitching 84 is also applied to the bottom portion of the glove section 12. It will be understood by those skilled in the art that the decorative stitching is applied during the manufacturing process at appropriate points which will not interfere with the construction of the concealment holster.

Figure 5:
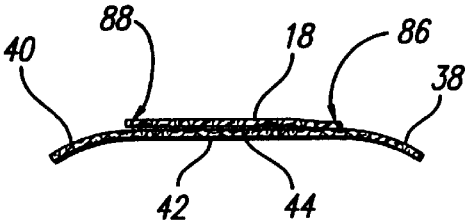
FIG. 5 is a cross-sectional view taken about the lines 5—5 of FIG. 4.

As is shown in FIG. 5, the outwardly extending wings 40 and 38 of the paddle 30 have been curved downwardly as viewed in FIG. 5. This is normally accomplished during the manufacturing process prior to stitching the planar member 18 to the paddle as above described. As is illustrated in FIG. 5, the metal support member 44 is sandwiched between the body section 42 of the paddle 30 and the planar element 18 of the glove and thumb break member 10. Appropriate stitching is illustrated at 86 and 88 to secure these elements and members together.

Figure 6:
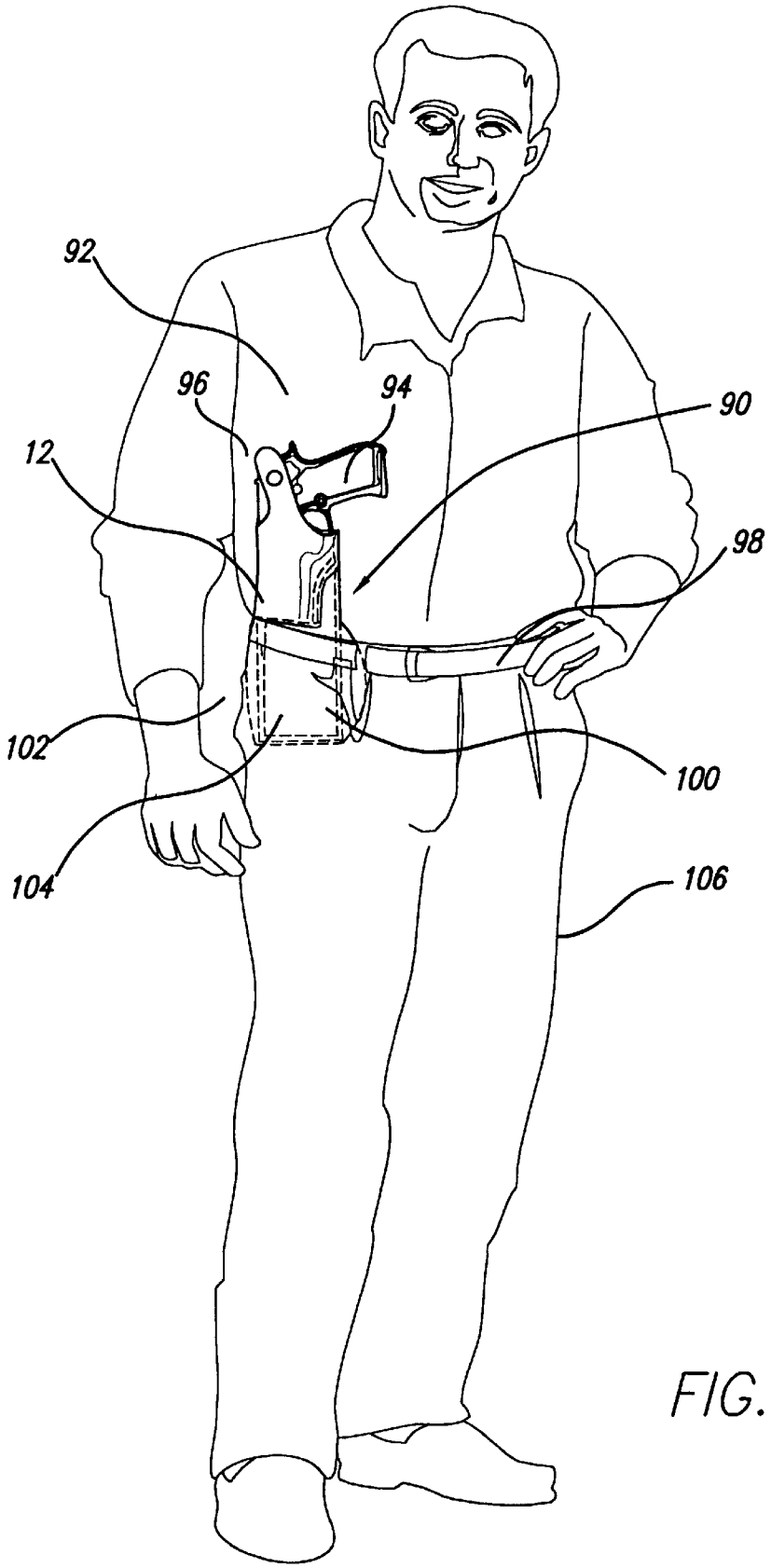
FIG. 6 is a schematic view showing a concealment holster constructed in accordance with the invention in position upon the person of a wearer.

As shown in FIG. 6, the concealment holster 90 is illustrated in position upon the body of a wearer 92. As will be clearly recognized, the glove section 12 holding the handgun 94 with the thumb break 96 in place extends above the belt or waist 98 of the wearer in position for use. However, the wings 100 and 102 of the paddle as well as the lower portion 104 of the glove and thumb break member extend inside the trousers 106 of the wearer 92 and extend beneath the belt or waistline 98. It will now be appreciated that the curved wings 100 and 102 conform to the shape of the hip of the wearer and thus provide support and security for the holster during use as well as comfort. In addition thereto, the outer surfaces of the lower portion 104 of the glove and thumb break as well as the paddle and wings 100 and 102 are rough and these rough surfaces engage the clothing of the wearer 92, thus, preventing easy or undesired removal of the concealment holster 90 from the person of the wearer 92. At the same time the rough outside surfaces will hold the holster in position when the user wishes to uncouple the thumb break and withdraw the handgun 94 from the holster 90. It will also be appreciated that the handgun 94 is worn high on the hip of the wearer 92, so that it is readily accessible and that since the wings 100 and 102 and the lower portion of the glove and thumb break member are well beneath the waist 98 of the trousers 106, the holster 90 with the gun 94 in position therein may be easily concealed by a coat, sweater, windbreaker or the like while yet providing ready access to the handgun 94 by the wearer 92.

It should also be noted that the long thumb break is on the outside away from the body of the user whether a left handed (FIG. 4 and FIG. 6) or a right handed holster is formed. With the long thumb break so positioned, the thumb break is opened by a motion away from the user's body. Such action is more normal, more convenient and allows the user's thumb to naturally fall in place on the hammer of the gun. This will provide a faster draw of the gun from the holster than does a thumb break which breaks toward the user's body.

There has thus been disclosed a concealment holster which is simple and easy to manufacture, yet is capable of being placed in position upon the person of the user and retained there without the necessity of a belt loop or similar securing structure. The utilization of the paddle with the outwardly extending wings which are curved to fit the body of the wearer and are positioned beneath the trouser waist with the rough outer surfaces thereof in engagement with the clothing of the wearer provides substantial support as well as comfort to the wearer.

What is claimed is:

1. A concealment holster for holding a handgun and adapted to permit withdrawal of the handgun therefrom by a generally vertically upward movement, said holster adapted to be retained on the person of a user without the necessity of a belt loop, said holster comprising:

A) a paddle member having a body section with upper and lower portions and a pair of wings extending outwardly from said lower portion;

B) a glove member including a planar element and a glove section, said planar element extending below said glove section and substantially along said lower portion of said paddle member body section, said glove section being adapted to receive and contain said handgun;

C) a support member sandwiched between said paddle member and said glove member planar element; and D) means for permanently securing said glove member to said paddle member with said support member therebetween.

2. A concealment holster as defined in claim 1 wherein said glove member and paddle member are constructed of leather and said support member is constructed of metal.

3. A concealment holster as defined in claim 2 wherein said support member extends substantially along said body section of said paddle member.

4. A concealment holster as defined in claim 3 wherein said support member is adhesively secured to at least one of said paddle member and glove member and thereafter said means for permanently securing is stitching.

5. A concealment holster as defined in claim 1 which further includes a thumb break.

6. A concealment holster as defined in claim 5 wherein said thumb break is formed integrally with said glove member.

7. A concealment holster as defined in claim 6 wherein said glove section, said planar element and said thumb break are formed from a first single piece of leather.

8. A concealment holster as defined in claim 7 wherein said paddle member is formed from a second single piece of leather.

9. A concealment holster as defined in claim 5 wherein said thumb break is released by a motion away from the user's body.

* * * * *